United States Patent [19]

Farish

[11] 3,991,994

[45] Nov. 16, 1976

[54] ZIG-ZAG WEB FOLDER APPARATUS

[75] Inventor: H. Greggs Farish, Salem, Ill.

[73] Assignee: Wood Industries, Inc., Middlesex, N.J.

[22] Filed: Apr. 29, 1975

[21] Appl. No.: 572,835

Related U.S. Application Data

[63] Continuation-in-part of Ser. No. 413,176, Nov. 5, 1973, abandoned.

[52] U.S. Cl. ..... 270/73; 270/69

[51] Int. Cl.[2] ..... B65H 45/16

[58] Field of Search ..... 270/73, 79, 61 F, 69, 270/39–40

[56] References Cited

UNITED STATES PATENTS

| | | | |
|---|---|---|---|
| 940,933 | 11/1909 | Klein | 270/79 |
| 1,186,018 | 6/1916 | Meisel | 270/69 |
| 1,327,588 | 1/1920 | Brown | 270/79 |
| 3,363,896 | 1/1968 | McKindary | 270/79 X |

*Primary Examiner*—Edgar S. Burr
*Assistant Examiner*—A. Heinz
*Attorney, Agent, or Firm*—Pennie & Edmonds

[57] ABSTRACT

A web folder apparatus for folding a running web at fixed intervals into zig-zag folds along fold lines which traverse the web. The apparatus has first and second folding cylinders adapted to rotate in opposite directions each of which has a non-rotatable gripping means spaced from and associated therewith to selectively grip a portion of the web along a fold line, each of the cylinders has vacuum means on the periphery thereof to assist in carrying the web around a portion of each cylinder to contact an associated gripping means, and at least one of the cylinders has air pressure ports in the periphery thereof which are circumferentially spaced from the vacuum means and through which air is adapted to flow radially outwardly of the cylinder to urge the web in contact with the cylinder away therefrom and to propel it in the direction of the folded web.

3 Claims, 3 Drawing Figures

ZIG-ZAG WEB FOLDER APPARATUS

This application is a continuation-in-part of application Ser. No. 413,176, now abandoned, filed Nov. 5, 1973.

BACKGROUND OF THE INVENTION

Web folding apparatus for folding endless webs in a zig-zag manner are known in the art. Such apparatus has included spiral winders at the corners or use of rotating grips that rotate with the folding cylinders to grippers the web, swing it in a radius and then release it in order to impart a fold. Other apparatus has utilized tuckers or swinging and reciprocating arms to impart the zig-zag folds. Some folder apparatus have utilized vacuum and pressure means associated with the folding cylinders to hold the web to the cylinders and to move the web from the cylinders. Thus, for example, in U.S. Pat. No. 940,933 to Klein, apparatus is disclosed which utilizes apertures in rotatable folder cylinders where the apertures alternatively operate in a pressure or vacuum mode to assist in imparting a fold to the web. Other apparatus, for example that disclosed in U.S. Pat. No. 1,186,018 to Meisel and Pat. No. 1,502,333 to Braunstein, have utilized separate vacuum and pressure ports in rotating cylinders to hold the web to the cylinders and to move it therefrom.

Still further, web folding devices have been utilized which use mechanically operated gripper units which are spaced from the rotating folding cylinders to positively grip the web along a fold line and which use vacuum means in the cylinder for transporting the web off the gripper means. Such machines, as also the above-mentioned prior art machines, have been subjected to jam up problems, particularly when operating at fast speeds. It is therefore an object of my invention to provide for a web folding machine which will utilize the advantages of mechanically-operated gripping units to positively grip and hold a web to a web folding cylinder, which may have vacuum means to assist in transporting the web to the gripper means and which at the same time have means allowing rapid operation of the machine without danger of a web jam up.

GENERAL DESCRIPTION OF THE INVENTION

Broadly, a web folder device constructed according to the invention has first and second rotatable folding cylinders which are adapted to rotate in opposite directions and which form a bite therebetween. A mechanically operated gripping means is associated with and spaced from each cylinder and is adapted to selectively grip the web along a fold line. Vacuum means may be included in both cylinders to assist in transporting the web, firstly around a portion of the first cylinder such that it will be engaged by its associated gripping means, and then secondly, around a portion of the second cylinder so that it will be gripped by its associated gripper means. In this manner the web is folded in a zig-zag manner at the gripper means. After the web is folded by a gripper means, it is then released therefrom so that the fold may fall down on to a conveyor belt. Air ports are included in the periphery of one of the cylinders through which air may flow to propel the web in contact with that cylinder away from the periphery thereof when its associated gripper means releases a fold. This will impel a fold away from the cylinder towards previously folded portions of the web to thus assure that the web will not remain in contact with the cylinder which, under fast folding conditions, could result in a jam up of the web passing through the folder device.

DETAILED DESCRIPTION OF THE EMBODIMENT

Figure 1:
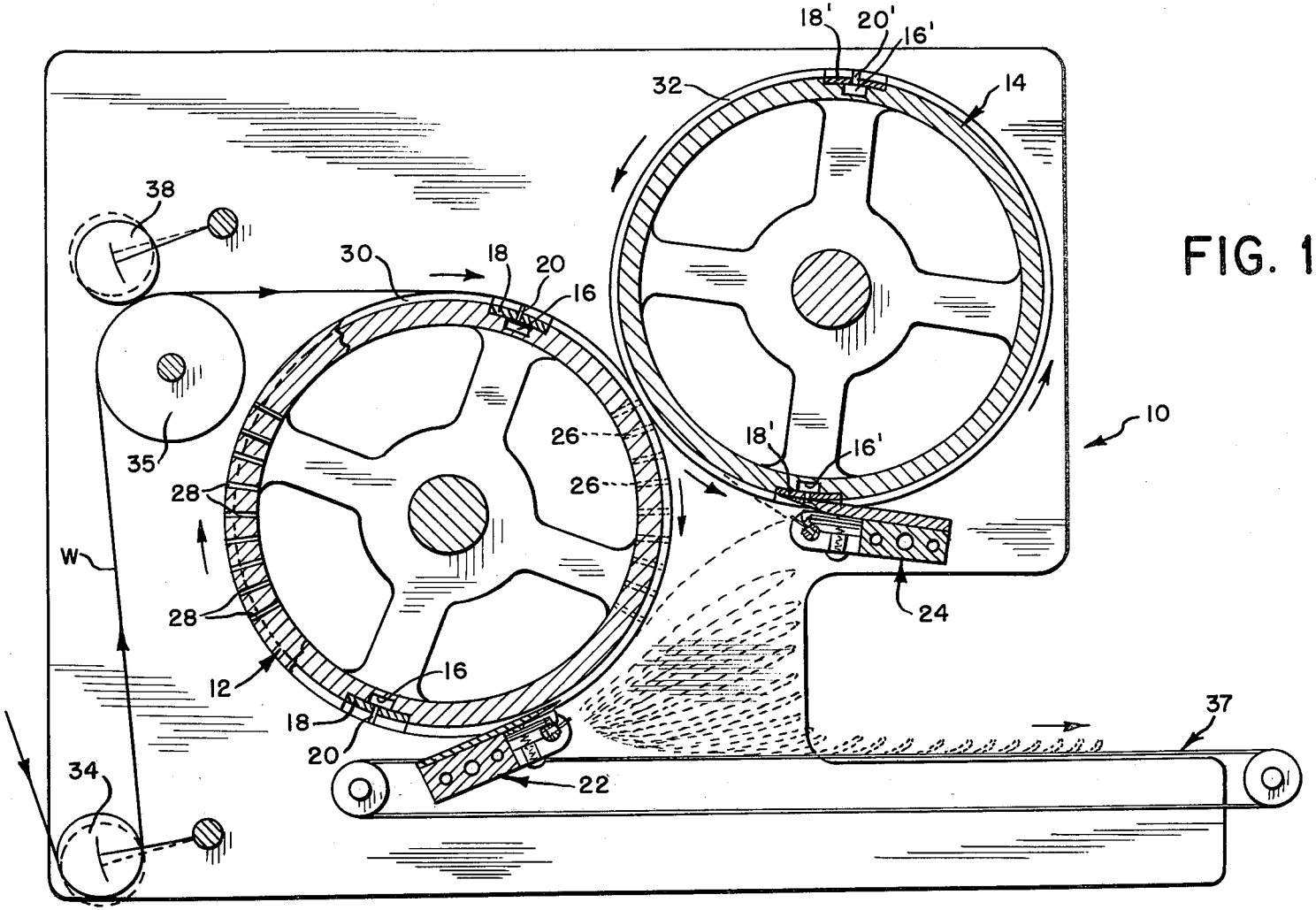
FIG. 1 is a side sectional view of a folder device constructed according to the invention.

Referring to FIG. 1, there is illustrated a web folder 10 comprising a first rotatable folding cylinder 12 and a second rotatable folding cylinder 14 which form a bite area therebetween. As shown, cylinder 12 is adapted to rotate in a clockwise direction whereas cylinder 14 is adapted to rotate in a counter-clockwise direction. Both cylinders 12 and 14 have diametrically opposed ducts 16 and 16′ near their peripheries extending axially of the cylinder which are overlaid by inserts 18 and 18′ each having therein a plurality of radially extending apertures 20 and 20′. Ducts 16 and 16′ are connected to a vacuum source such that the apertures 20 and 20′ have a negative pressure therein. The vacuum source may comprise a conventional manifold at the end of the cylinder which connects with the duct at predetermined rotational arcs. With respect to cylinder 12, the arcs would extend approximately 120° in the direction of rotation from the web contact area, and with respect to cylinder 14, the arcs would extend approximately 55° from the web contact area in the direction of rotation.

The cylinder 12 has a mechanically operated gripper means 22 which is fixed and spaced with respect thereto. Cylinder 14 has a similar gripper means 24 which is also fixed and spaced with respect thereto.

Figure 3:
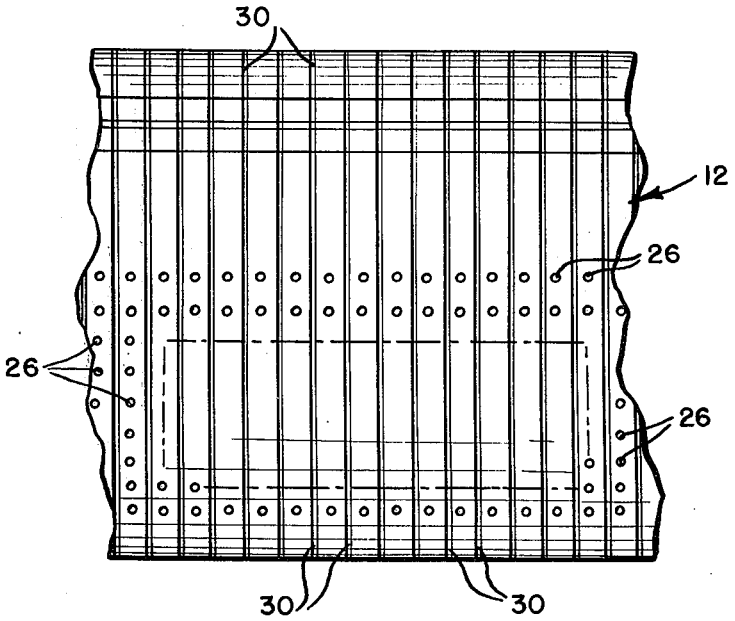
FIG. 3 is a plan view of a portion of a folding cylinder illustrated in FIG. 1.

The cylinder 12 has a plurality of air ports 26 and a plurality of air ports 28 which are oppositely disposed to each other and which extend from the interior of the cylinder to the exterior. Each of the ports 26 and each of the ports 28 are circumferentially spaced from each other and each plurality of ports 26 and 28 extends over a circumferential area which is less than one-quarter of the circumference of cylinder 12. As shown in FIG. 3, cylinder 12 has circumferentially extending grooves 30 which are axially spaced from one another with the apertures 26 and 28 extending through portions of the cylinder between the grooves. The cylinder 14 also has grooves 32 which are spaced in the same manner as the grooves 30 on the cylinder 12.

As shown in FIG. 1, a web W passes from a web source over a trolley roll 34, between a driven roll 35 and a further trolley roll 38, through the bite formed between cylinders 12 and 14 and on to the selectively operated gripper means 22 and 24 which impart folds into the web. The folded web is then released by the gripper means and drops onto a conveyor 37 which moves it to a further processing station.

Figure 2:
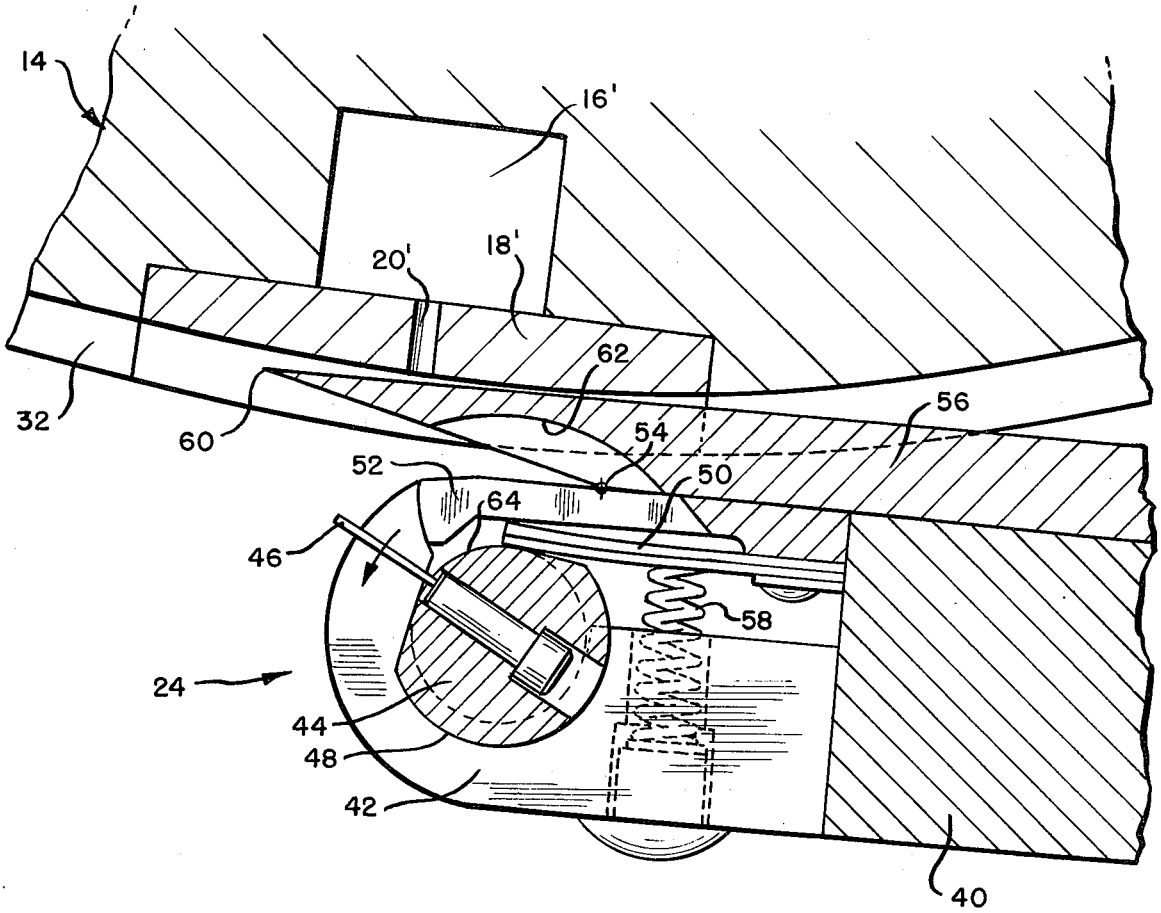
FIG. 2 is an enlarged secional view of a portion of FIG. 1 illustrating a gripper means.

Referring to FIG. 2, there is illustrated in greater detail the gripper means 24 which is identical with gripper means 22 and which comprises a support bracket 40 having thereon a bearing arm 42 in which a cam shaft 44 is rotatably mounted. The cam shaft carries a comber pin 46 which is adapted to engage an edge of a fold of the web to move it from the gripping means. The cam shaft 44 has a cam rise 48 thereon which is adapted to engage and move a spring bearing plate 50 which in turn engages a folding blade 52 so as to move the blade about a pivot point 54 contained on folding finger 56 against the force of a spring 58. The folding finger has a pointed edge 60 to assist in guiding a fold into an area between the finger 56 and the blade 52 where it may be gripped by the gripper means as explained more fully hereafter. As shown, the folding blade 56 extends into the groove 32 and has a cut out 62 therein through which the pin 46 may rotate. The cam shaft extends across the width of the web and preferably a finger and comber pin would be included to extend into each groove 32. The cam shaft 44 is connected by gearing not shown to the drive means for rotating the cylinder 14 and the ratio of the drive means is such that the cam shaft 44 will rotate twice to every revolution of the cylinder 14.

The operation of the device is as follows. As the web advances onto cylinder 12, it is carried to the bite area formed between the cylinders 12 and 14. The suction aperture 20 of cylinder 12 will hold the web on the periphery of the cylinder after the web leaves the bite area and will transport the web around to the gripper means 22. At this point, that is where the apertures 20 are adjacent the gripper means 22, the apertures 20' of cylinder 14 will be at the bite area. Suction exerted by apertures 20' will then hold the web to the periphery of cylinder 14 and move the web towards the gripper means 24, as shown in FIG. 1 with the web folding along a line. At the same time, air is ejected by centrifugal force through the apertures 26 to propel the web that was in contact with the cylinder 12 downwardly towards the folded webs and conveyor belt. This forceful propelling of the web from the periphery of the cylinder 12 assures that there will be no jam up of web at the bite notwithstanding the speed of operation of the machine.

In order to facilitate the flow of the air, the ends of cylinder 12 are open. It is obvious that the ends of the cylinder could be connected by a manifold means in the same manner as the vacuum ducts 16 to a source of air pressure such that air would be ejected through the apertures 26 and 28 only through that portion of the quadrant of rotation of the cylinder extending from the bite area in the direction of rotation to the gripper means 22.

Referring to FIG. 2, as an individual fold of the web is transported to the pointed edge 60 of the folder finger by the web being held to rotating cylinder 14 by the suction exerted by apertures 20', the bottom of the fold will be engaged by the edge 60 so directing the fold towards the fulcrum point 54. At this point in rotation of the cylinder 14, the cam rise 48 will engage the spring clips 50 to move the folder arm 52 about the fulcrum point so that the web will be positively gripped between the upper part of the folder arm 52 and the surface 62 of the folder finger. As the cam shaft continues to rotate, the rise portion will rotate beyond engagement to the dwell area 64 which will allow the spring clips 50 to move downward. Arm 52 will thus pivot in a clockwise direction around the fulcrum 54 under the force of the spring 58. Continued rotation of the shaft will bring the comber pin 46 into engagement with the fold line to forcefully eject the web from the gripper section so that the fold may fall towards the conveyor belt. The operation of the gripper means 24 is in all respects the same as that of gripper means 22.

Preferably the cylinders 12 and 14 have a clearance between their outer peripheries which is slightly greater than the maximum thickness of a spliced web. This will insure that the spliced web may freely pass through the bite area and not be subjected to a jam up.

A folder constructed according to the invention utilizing the air ejection means for propelling the web from the folding roll has been found to result in a faster folding operation while at the same time reducing the possibility of a web jam up.

I claim:

1. In a web folder having first and second web folding cylinders rotatable in opposite directions to form a bite therebetween through which a web is adapted to extend, a non-rotatable gripping means associated with and spaced from each said cylinder for selectively gripping transversely extending portions of the web to fixedly hold said portions with respect to the periphery of said cylinders, and vacuum means on peripheral portions of each said cylinder for transporting the web around a portion of said first cylinder to be engaged by its associated gripper means and then alternatively around a portion of said second cylinder to be engaged by its associated gripper means whereby a web may be folded in a zig-zag manner; the improvement comprising having a plurality of circumferentially spaced air ports in said first cylinder extending over less than one-quarter of the circumference of said cylinder and circumferentially spaced from said vacuum means, and air flow means separate from said vacuum means for exerting a flow of air through said ports radially outwardly of said first cylinder whereby the portion of a web held relative to the periphery of said cylinder by its associated gripper means will be propelled away therefrom towards folds of the web when the portion is released by the gripper means associated with the first cylinder.

2. In a web folder according to claim 1 the improvement further comprising in having two vacuum means on the periphery of each said cylinder diametrically opposed to each other and having two groups of a plurality of air ports on each said cylinder with each said group being circumferentially spaced between said vacuum means and being diametrically opposed to each other.

3. In a web folder according to claim 2 wherein said first cylinder is hollow and has open ends whereby when said first cylinder is rotated, air is ejected from the interior of said first cylinder through said air ports by centrifugal force.

* * * * *